US009163480B2

(12) United States Patent
Crabb et al.

(10) Patent No.: US 9,163,480 B2
(45) Date of Patent: Oct. 20, 2015

(54) DECOUPLING A REMOTE ACTUATOR OF A WELL TOOL

(71) Applicant: Halliburton Energy Services, Inc., Houston, TX (US)

(72) Inventors: James Crabb, Arbroath (GB); Frank David Kalb, Lantana, TX (US); Andrew John Webber, Coppell, TX (US); William James Goodall, Fortrose (GB)

(73) Assignee: Halliburton Energy Services, Inc., Houston, TX (US)

( * ) Notice: Subject to any disclaimer, the term of this patent is extended or adjusted under 35 U.S.C. 154(b) by 344 days.

(21) Appl. No.: 13/762,794

(22) Filed: Feb. 8, 2013

(65) Prior Publication Data

US 2013/0213673 A1 Aug. 22, 2013

(30) Foreign Application Priority Data

Feb. 10, 2012 (WO) ..... PCT/US2012/024676

(51) Int. Cl.

| | |
|---|---|
| ***E21B 34/06*** | (2006.01) |
| ***E21B 23/00*** | (2006.01) |
| ***E21B 34/10*** | (2006.01) |
| ***E21B 34/14*** | (2006.01) |

(52) U.S. Cl.

CPC ..... *E21B 34/066* (2013.01); *E21B 23/00* (2013.01); *E21B 34/10* (2013.01); *E21B 34/107* (2013.01); *E21B 34/14* (2013.01)

(58) Field of Classification Search

CPC ..... E21B 34/10; E21B 34/107; E21B 23/00
See application file for complete search history.

(56) References Cited

U.S. PATENT DOCUMENTS

| | | | | |
|---|---|---|---|---|
| 3,696,868 | A | 10/1972 | Taylor, Jr. | |
| 3,882,935 | A | 5/1975 | Calhoun | |
| 3,886,967 | A | 6/1975 | Nelson | |
| 3,896,876 | A | 7/1975 | Crowe | |
| 3,912,008 | A | 10/1975 | Crowe | |
| 3,939,913 | A | 2/1976 | Mott | |
| 3,955,624 | A | 5/1976 | Fredd et al. | |
| 4,344,602 | A | 8/1982 | Arendt | |
| 4,356,867 | A * | 11/1982 | Carmody | 166/373 |
| 4,417,600 | A | 11/1983 | Kohn | |

(Continued)

FOREIGN PATENT DOCUMENTS

| | | |
|---|---|---|
| EP | 0023765 A1 | 2/1981 |
| NO | 313108 | 5/1997 |

OTHER PUBLICATIONS

Authorized Officer Philippe Becamel, PCT International Preliminary Report on Patentability, PCT/US2012/024676, Aug. 21, 2014, 6 pages.

(Continued)

*Primary Examiner* — Brad Harcourt
(74) *Attorney, Agent, or Firm* — Scott Richardson; Fish & Richardson P.C.

(57) ABSTRACT

A well tool with a housing has an actuator sleeve in the housing. The actuator sleeve has an internal shifting tool engaging profile. An actuator is in the housing. The actuator is responsive to a remote signal to move the actuator sleeve from a first position to a second position. A dog is in the housing, supported to couple the actuator sleeve to the actuator when the actuator sleeve is in the first position and unsupported to allow the actuator sleeve to uncouple from the actuator when the actuator sleeve is in the second position.

22 Claims, 11 Drawing Sheets

(56) References Cited

U.S. PATENT DOCUMENTS

| | | | |
|---|---|---|---|
| 4,420,041 | A | 12/1983 | Patel |
| 4,425,965 | A | 1/1984 | Bayh, III et al. |
| 4,436,157 | A | 3/1984 | Brooks |
| 4,449,587 | A | 5/1984 | Rodenberger et al. |
| 4,522,370 | A | 6/1985 | Noack et al. |
| 4,552,219 | A | 11/1985 | Wong et al. |
| 4,603,740 | A | 8/1986 | Edwards et al. |
| 4,603,742 | A | 8/1986 | Wong et al. |
| 4,605,070 | A | 8/1986 | Morris |
| 4,624,315 | A | 11/1986 | Dickson et al. |
| RE32,343 | E | 2/1987 | Vinzant et al. |
| 4,657,082 | A | 4/1987 | Ringgenberg |
| 4,664,195 | A | 5/1987 | Deaton |
| 4,667,736 | A | 5/1987 | Rumbaugh et al. |
| 4,703,805 | A | 11/1987 | Morris |
| 4,723,606 | A | 2/1988 | Vinzant et al. |
| 4,726,421 | A | 2/1988 | Akkerman et al. |
| 4,749,043 | A | 6/1988 | Rodenberger |
| 4,834,175 | A | 5/1989 | Ross et al. |
| 4,834,183 | A | 5/1989 | Vinzant et al. |
| 4,903,775 | A | 2/1990 | Manke |
| 4,934,652 | A | 6/1990 | Golden |
| 4,944,345 | A | 7/1990 | Mashaw, Jr. |
| 4,945,993 | A | 8/1990 | Dickson et al. |
| 4,997,038 | A | 3/1991 | Welch |
| 5,022,427 | A | 6/1991 | Churchman et al. |
| 5,050,839 | A | 9/1991 | Dickson et al. |
| 5,141,023 | A | 8/1992 | Dollison et al. |
| 5,518,073 | A | 5/1996 | Manke et al. |
| 5,810,087 | A | 9/1998 | Patel |
| 5,826,661 | A | 10/1998 | Parker et al. |
| 5,950,733 | A | 9/1999 | Patel |
| 6,085,845 | A | 7/2000 | Patel et al. |
| 6,230,807 | B1 | 5/2001 | Patel |
| 6,321,847 | B1 | 11/2001 | Brown |
| 7,438,130 | B2 | 10/2008 | Read, Jr. |
| 2007/0235199 | A1 | 10/2007 | LoGiudice et al. |

OTHER PUBLICATIONS

Otis Engineering Corporation, "Series 10® Flapper-Type Valves" 1989 (2 pages).

Otis Engineering Corporation, Otis Remote-Controlled Wireline-Retrievable Tubing Safety Valves (Storm Choke®) 1974-75 Catalog (2 pages).

Halliburton, "FS2 Fluid Loss Isolation Barrier Valve" Completion Tools, May 2012 (2 pages).

Halliburton, "FS2 Valve" Completion Tolls, Mar. 2010 (1 page).

Authorized officer Park Sang Hyun, International Search Report and Written Opinion in International Application No. PCT/US2012/024676, mailed Oct. 29/2012, 9 pages.

* cited by examiner

DECOUPLING A REMOTE ACTUATOR OF A WELL TOOL

BACKGROUND

This disclosure relates to remotely and mechanically actuated tools for use in subterranean well systems.

There are numerous tools for use in a subterranean well that can be remotely actuated by a hydraulic, electric, and/or other type of signal generated remote from the tool. Some of these tools further include provisions for mechanical actuation, for example, by a shifting tool manipulated from the surface. The mechanical actuation provides an alternative or contingency mode of actuation apart from actuation in response to the remote signal. In actuating the tool manually, however, the shifting tool must overcome the remote actuator mechanism or the remote actuator mechanism must be uncoupled from the actuated element of the tool.

SUMMARY

This disclosure describes a well tool that is both remotely and mechanically actuated. The remote actuator is coupled to the actuator sleeve in a manner that can transmit a high amount of force from the actuator, yet can be changed to allow the actuator sleeve to uncouple from the remote actuator with a low, specified force.

Certain aspects encompass a well tool with a housing. An actuator sleeve is in the housing. The actuator sleeve has an internal shifting tool engaging profile. An actuator is in the housing. The actuator is responsive to a remote signal to move the actuator sleeve from a first position to a second position. A dog is in the housing, supported to couple the actuator sleeve to the actuator when the actuator sleeve is in the first position and unsupported to allow the actuator sleeve to uncouple from the actuator when the actuator sleeve is in the second position.

Certain aspects encompass a method of actuating a well tool where a dog is supported to couple a portion of an actuator to an actuator sleeve. The actuator is operated to axially shift the portion and the actuator sleeve while the dog is coupling the portion to the actuator sleeve. Then, the dog is unsupported to allow the actuator sleeve to uncouple from the actuator.

Certain aspects encompass a device for use in a subterranean well. The device has an actuator responsive to actuate in response to a signal generated remote from the device. An actuator sleeve is coupled to an actuated element of the device to operate the actuated element when the actuator shifts axially in the device. A dog couples the actuator to the actuator sleeve and allows the actuator to uncouple from the actuator sleeve when the actuator has been remotely actuated.

The details of several examples are set forth in the accompanying drawings and the description below. Other features, objects, and advantages will be apparent from the description and drawings, and from the claims.

DESCRIPTION OF DRAWINGS

FIG. 2A shows the example valve in an open position. FIG. 2B shows the example valve in a closed position.

FIGS. 3A and 3B show the coupling assembly coupling the remote actuator assembly to the actuator sleeve, respectively in a perspective view and in a side cross sectional view. FIG. 3C shows in a side cross-sectional view the coupling assembly uncoupled so that the actuator sleeve moves freely with respect to the remote actuator assembly.

FIGS. 4A, 4B and 4C show the coupling assembly coupling the remote actuator assembly to the actuator sleeve, respectively in a perspective view, in a front cross sectional view, and in a side cross sectional view.

FIGS. 5A and 5B show the coupling assembly in a perspective view and in an axial cross sectional view, respectively. FIG. 5C shows in a side cross-sectional view the coupling assembly uncoupled so that the actuator sleeve moves freely with respect to the remote actuator assembly.

Like reference symbols in the various drawings indicate like elements.

DETAILED DESCRIPTION

Figure 1:
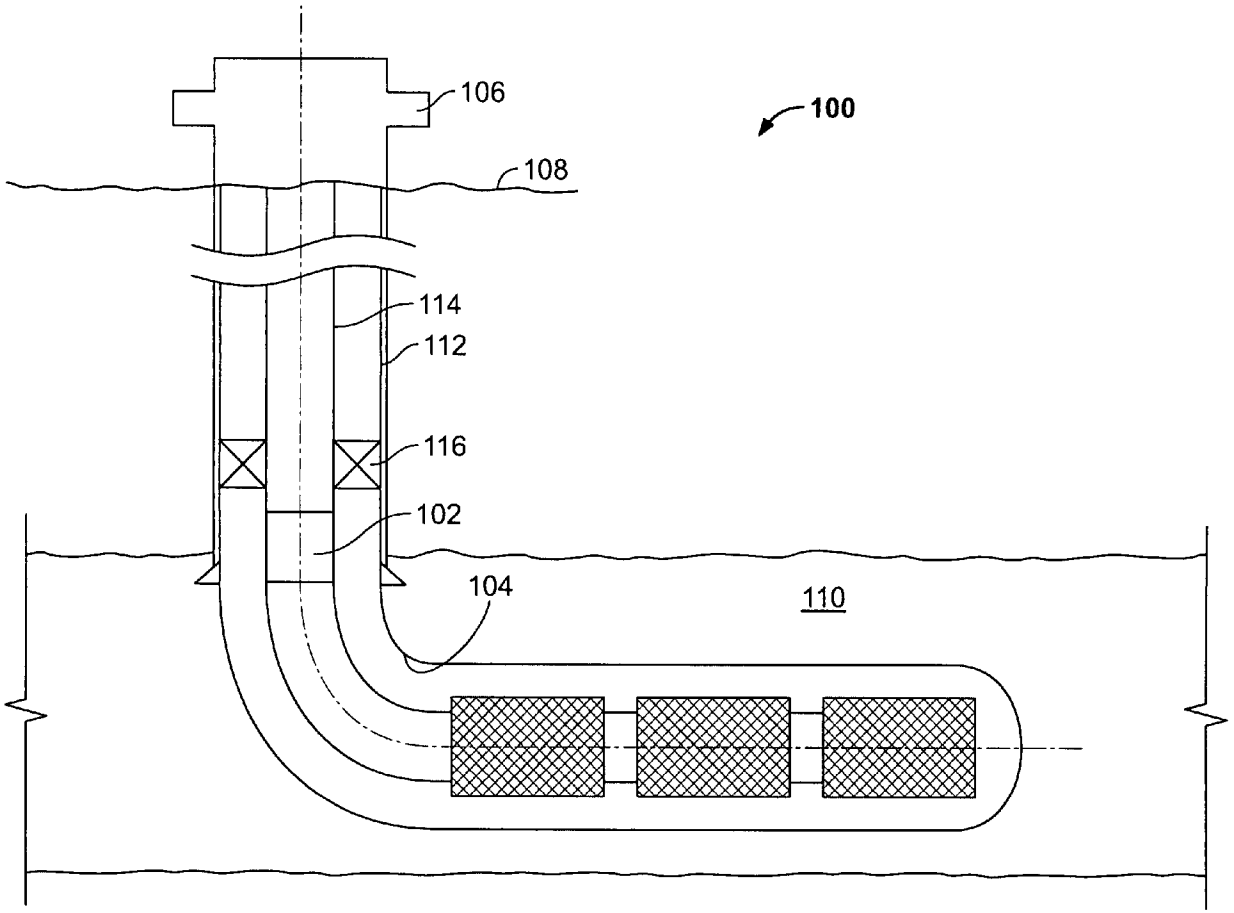
FIG. 1 is a side cross-sectional view of an example well system.

FIG. 1 is a side cross-sectional view of a well system 100 with an example valve 102 constructed in accordance with the concepts herein. The well system 100 is provided for convenience of reference only, and it should be appreciated that the concepts herein are applicable to a number of different configurations of well systems. As shown, the well system 100 includes a substantially cylindrical well bore 104 that extends from well head 106 at a terranean surface 108 through one or more subterranean zones of interest 110. In FIG. 1, the well bore 104 extends substantially vertically from the surface 108 and deviates to horizontal in the subterranean zone 110. However, in other instances, the well bore 104 can be of another configuration, for example, entirely substantially vertical or slanted, it can deviate in another manner than horizontal, it can be a multi-lateral, and/or it can be of another configuration.

The well bore 104 is lined with a casing 112, constructed of one or more lengths of tubing, that extends from the well head 106 at the surface 108, downhole, toward the bottom of the well 104. The casing 112 provides radial support to the well bore 104 and seals against unwanted communication of fluids between the well bore 104 and surrounding formations. Here, the casing 112 ceases at the subterranean zone 110 and the remainder of the well bore 104 is an open hole, i.e., uncased. In other instances, the casing 112 can extend to the bottom of the well bore 104 or can be provided in another configuration.

A completion string 114 of tubing and other components is coupled to the well head 106 and extends, through the well bore 104, downhole, into the subterranean zone 110. The completion string 114 is the tubing that is used, once the well is brought onto production, to produce fluids from and inject fluids into the subterranean zone 110. Prior to bringing the well onto production, the completion string is used to perform the final steps in constructing the well. The completion string 114 is shown with a packer 116 above the subterranean zone 110 that seals the annulus between the completing string 114 and casing 112, and directs fluids to flow through the completion string 114 rather than the annulus.

The example valve 102 is provided in the completion string 114 below the packer 116. The valve 102 when open, allows passage of fluid and communication of pressure through the completion string 114. When closed, the valve 102 seals against passage of fluid and communication of pressure between the lower portion of the completion string 114 below the valve 102 and the upper portion of the completion string 114. The valve 102 has provisions for both mechanical and remote operation. As described in more detail below, for mechanical operation, the valve 102 has an internal profile that can be engaged by a shifting tool to operate the valve. For remote operation, the valve 102 has a remote actuator assembly that responds to a signal (e.g., a hydraulic, electric, and/or other signal) to operate the valve. The signal can be generated remote from the valve 102, for example at the surface.

In the depicted example, the valve 102 is shown as a fluid isolation valve that is run into the well bore 104 open, mechanically closed with a shifting tool and then eventually re-opened in response to a remote signal. The valve 102, thus allows an operator to fluidically isolate the subterranean zone 110, for example, while an upper portion of the completion string 114 is being constructed, while subterranean zones above the valve 102 are being produced (e.g., in a multilateral well), and for other reasons. The concepts herein, however, are applicable to other configurations of valves. For example, the valve 102 could be configured as a safety valve. A safety valve is typically placed in the completion string 114 or riser (e.g., in a subsea well), and is biased closed and held open by a remote signal. When the remote signal is ceased, for example, due to failure of the well system above the valve 102, the valve 102 closes. Thereafter, the valve 102 is mechanically re-opened to recommence operation of the well.

Figure 2A:
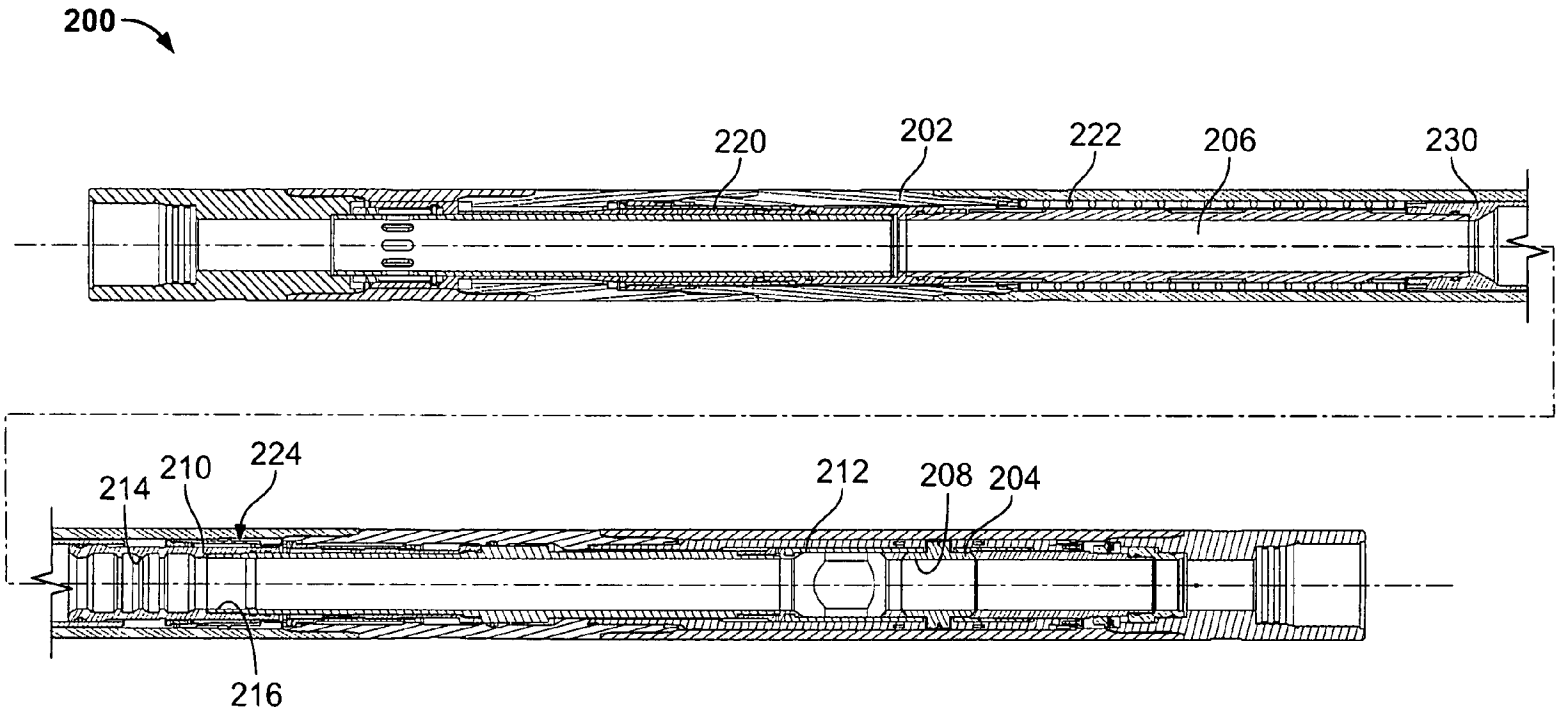
FIGS. 2A and 2B are detail side cross-sectional views of an example valve.
Figure 2B:
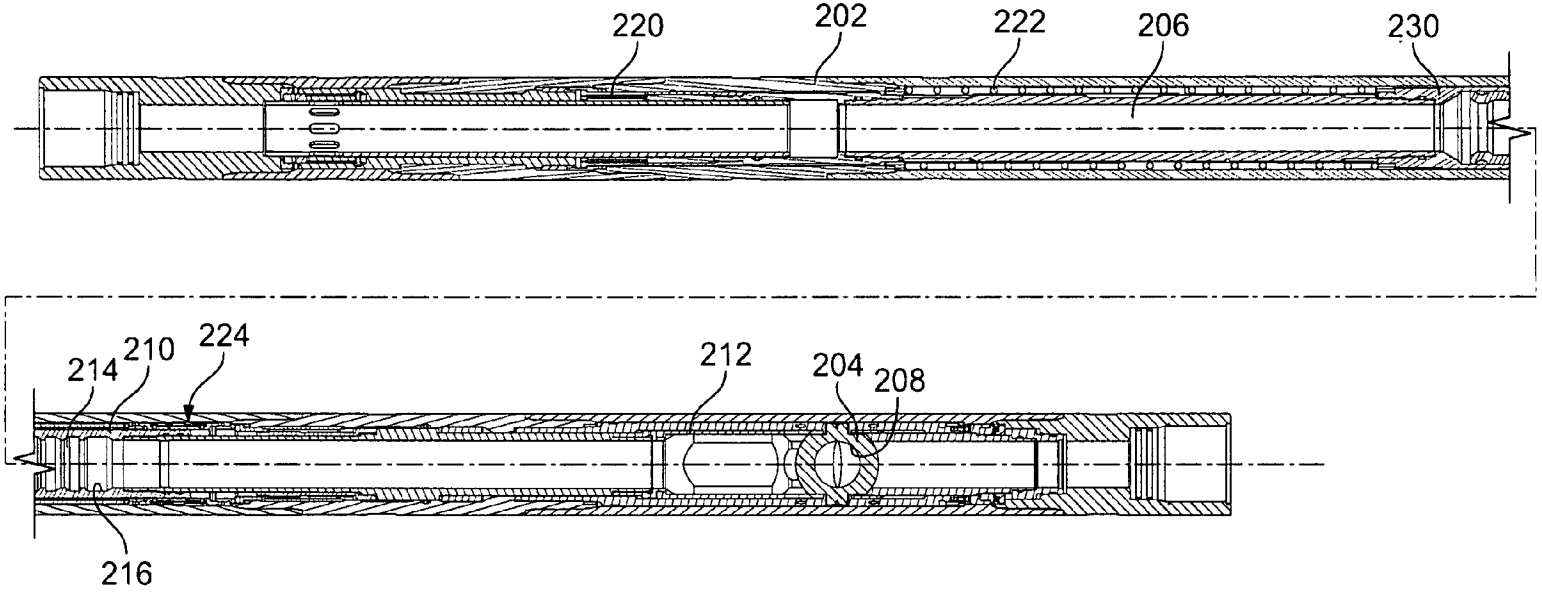

Turning now to FIGS. 2A and 2B, an example valve 200 is depicted in half side cross-section. The example valve 200 can be used as valve 102. The valve 200 includes an elongate, tubular valve housing 202 that extends the length of the valve 200. The housing 202 is shown as made up of multiple parts for convenience of construction, and in other instances, could be made of fewer or more parts. The ends of the housing 202 are configured to couple to other components of the completion string (e.g., threadingly and/or otherwise). The components of the valve 200 define an internal, cylindrical central bore 206 that extends the length of the valve 200. The housing 202 contains spherical ball-type valve closure 204 that, likewise, has a cylindrical, central bore 208 that is part of central bore 206. The central bore 206 is the largest flow bore through the valve 200. The valve closure 204 is carried to rotate about an axis transverse to the longitudinal axis of the valve housing 202. The valve 200 is open when the central bore 208 of the valve closure 204 aligns with and coincides with the central bore 206 of the remainder of the valve 200 (FIG. 2A). The valve 200 is closed when the central bore 208 of the valve closure 204 does not coincide with, and seals against passage of fluid and pressure through, the central bore 206 of the remainder of the valve 200 (FIG. 2B). In other instances, the valve closure 204 can be another type of valve closure, such as a flapper and/or other type of closure.

The valve closure 204 is coupled to an elongate, tubular actuator sleeve 210 via a valve fork 212. The actuator sleeve 210 is carried in the housing 202 to translate between an uphole position (FIG. 2B) and a downhole position (FIG. 2A), and correspondingly move the valve fork 212 between an uphole position and a downhole position. When the actuator sleeve 210 (and valve fork 212) are in the uphole position, the valve closure 204 is in the closed position. As the actuator sleeve 210 (and valve fork 212) translates to the downhole position, the valve closure 204 rotates around the transverse axis to the open position.

The valve 200 has provisions for remote operation, to operate the valve closure 204 in response to remote signal (e.g., a hydraulic, electric, and/or other signal). To this end, the valve 200 has a remote actuator assembly 220 that is coupled to the actuator sleeve 210. The actuator assembly 220 is responsive to the remote signal to shift the actuator sleeve 210 axially and change the valve between the closed and open positions. While the actuator assembly 220 can take a number of forms, depending on the desired operation of the valve, in certain instances of the valve 200 configured as a fluid isolation valve, the actuator assembly 220 is responsive to a specified number of pressure cycles (increase and decrease) provided in the central bore 208 to release compressed power spring 222 carried in the housing 202 and coupled to the actuator sleeve 210. The released power spring 222 expands and drives the actuator sleeve 210 axially from the uphole position to the downhole position, and thus changes the valve closure 204 from the closed position to the open position. In some implementations, the power spring 222 can be connected to the actuator sleeve 210 via a stop spring mandrel 230. The pressure cycles are a remote signal in that they are generated remotely from the valve 200, for example, by repeatedly opening and closing a valve in the production string at the surface, for example, in the well head. One example of such an actuator assembly can be found on the fluid loss isolation barrier valve sold under the trade name FS by Halliburton Energy Services, Inc.

The valve 102 has provisions for mechanical operation, to allow operating the valve closure 204 with a shifting tool inserted through the central bore 206. To this end, the actuator sleeve 210 has a profile 214 on its interior bore 216 that is configured to be engaged by a corresponding profile of the shifting tool. The profile 214 enables the shifting tool to grip the actuator sleeve 210 and move it between the uphole position and the downhole position, thus operating the valve closure 204 between the closed position and the open position. The shifting tool can be inserted into the valve 200 on a working string of tubing and other components inserted through the production string from the surface. One example of such an actuator sleeve and shifting tool are embodied in the fluid loss isolation barrier valve sold under the trade name FS by Halliburton Energy Services, Inc.

To facilitate mechanical operation of the valve 200, the actuator sleeve 210 can be uncoupled from the remote actuator assembly 220. Uncoupling the actuator sleeve 210 from the remote actuator assembly 220 reduces the amount of force the shifting tool must apply to move the actuator sleeve 210. For example, in a configuration having a power spring 222, if the actuator sleeve 210 is uncoupled from the remote actuator assembly 220, the shifting tool does not have to compress the power spring 222. Thus, the remote actuator assembly 220 is releasably coupled to the actuator sleeve 210 via a releasable coupling assembly 224. In some implementations, the housing 202 can have two or more different internal diameters, for example, a first internal diameter and a second, larger diameter. The first internal diameter can retain a dog that connects the actuator assembly 220 to the actuator sleeve 210 inward in engagement with the actuator sleeve 210 and coupling the actuator sleeve 210 to the actuator assembly 220 when the dog is within the first internal diameter. The dog, when translated into the second larger diameter during operation, is allowed to move outward, releasing the actuator sleeve 210 to uncouple from the actuator assembly 220.

Figure 3A:
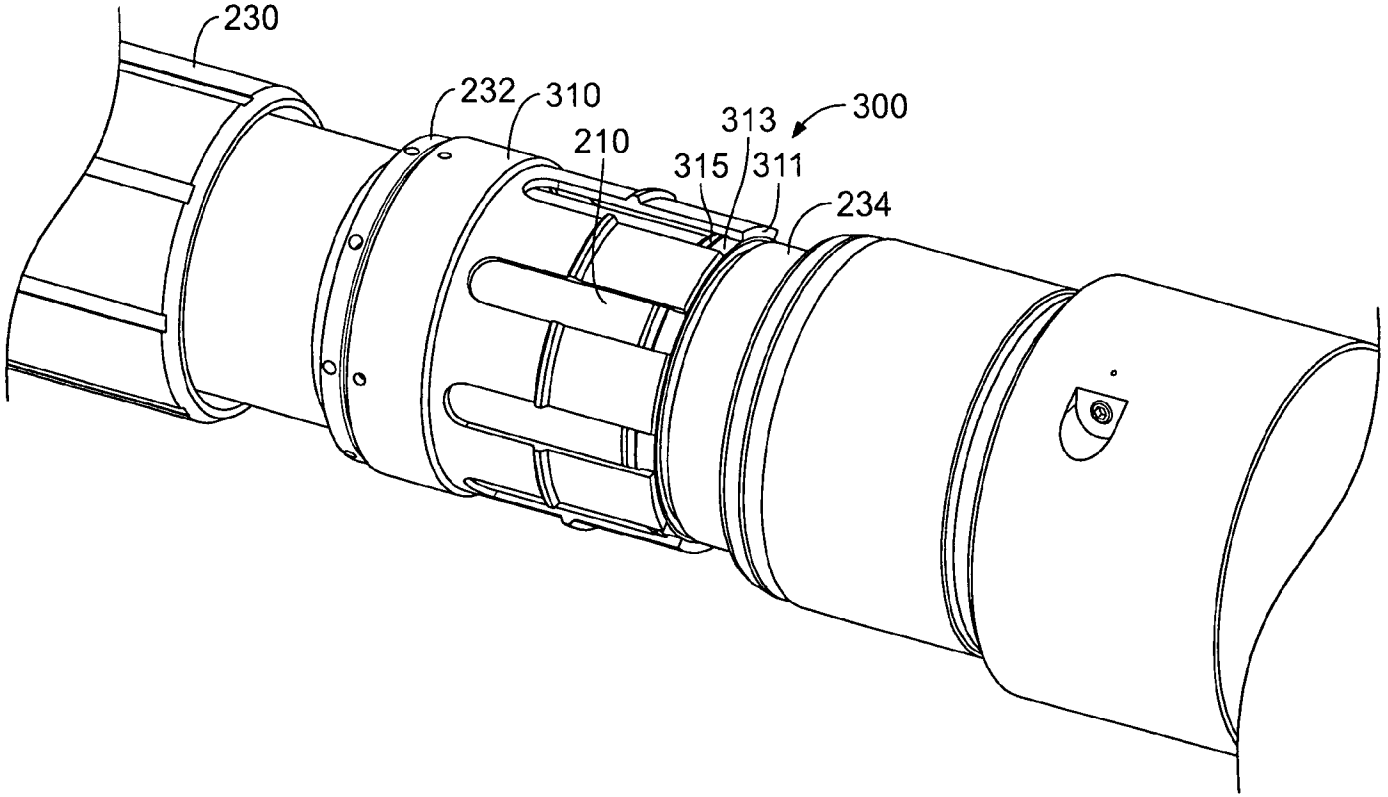
FIGS. 3A, 3B and 3C are detailed views of an example releasable coupling assembly.
Figure 3B:
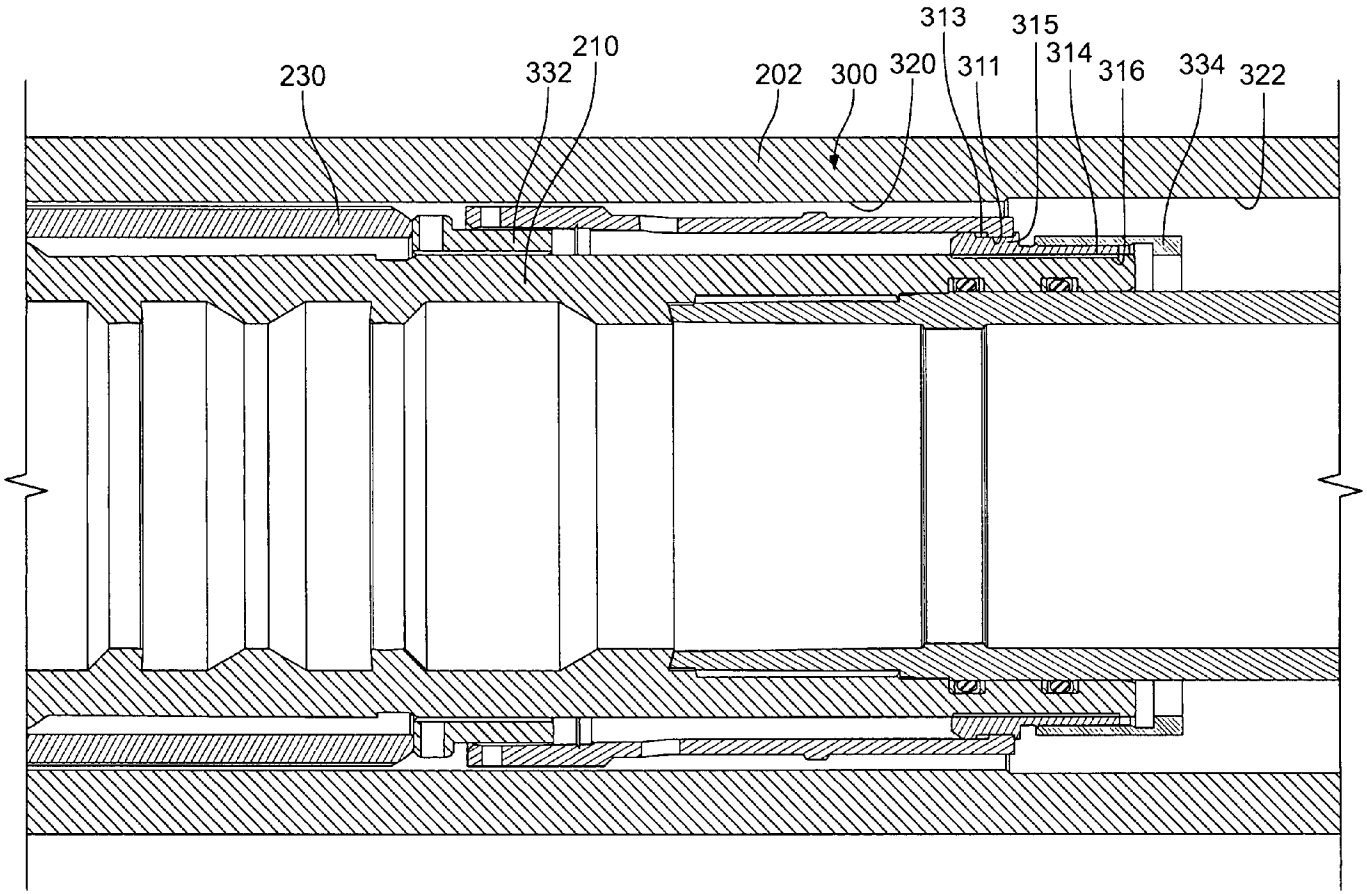
Figure 3C:
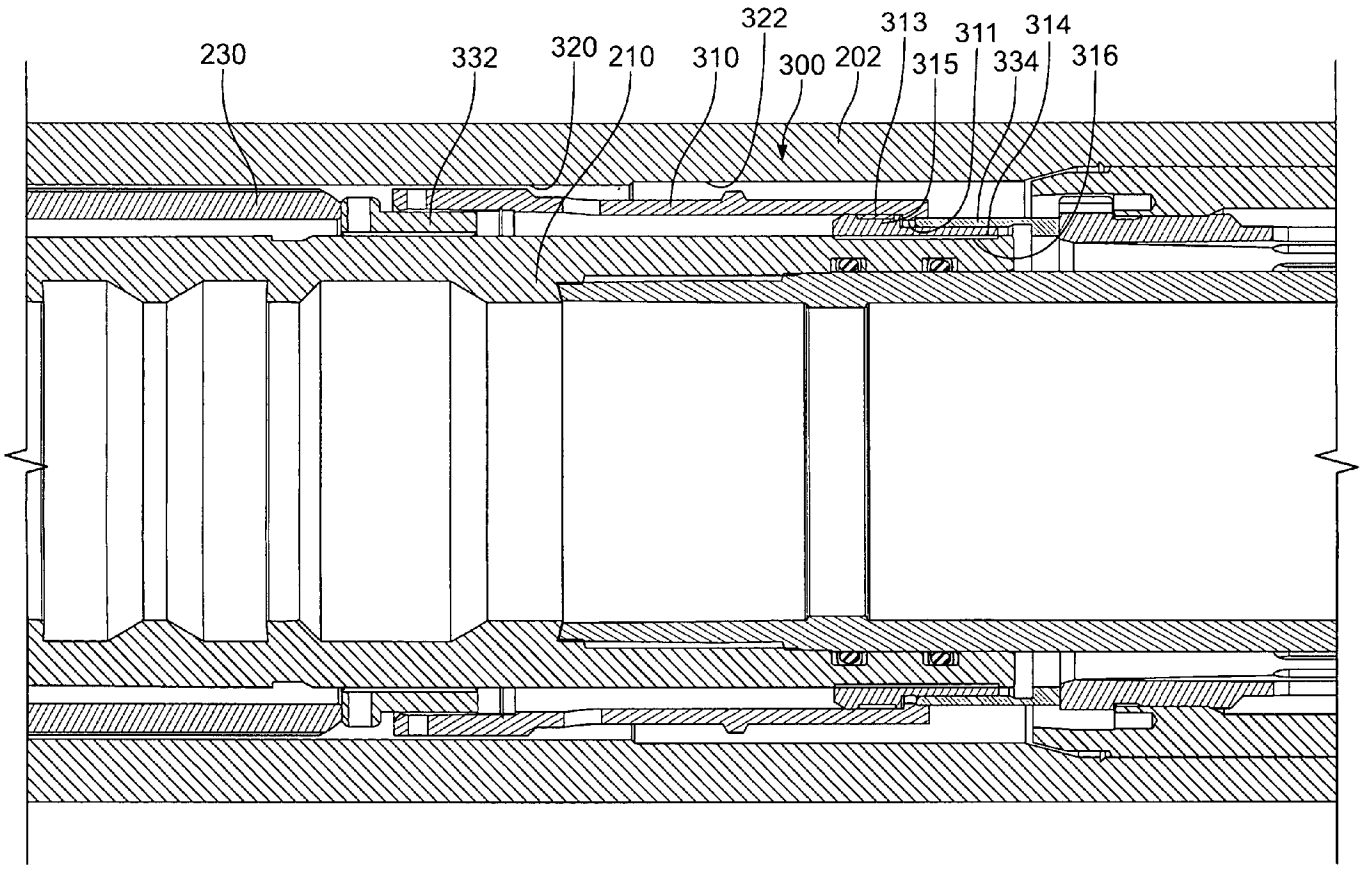

Referring now to FIGS. 3A, 3B, and 3C, an example releasable coupling assembly 300 is shown. The example releasable coupling assembly 300 can be used as releasable coupling assembly 224, and is shown in such context. FIGS. 3A and 3B show the coupling assembly coupling the remote actuator assembly to the actuator sleeve, in a perspective view (with the housing 202 omitted) and in a side cross sectional view, respectively. FIG. 3C shows, in a side cross-sectional view, the coupling assembly uncoupled so that the actuator sleeve moves freely with respect to the remote actuator assembly.

The example releasable coupling assembly 300 internally receives the actuator sleeve 210, and transmits actuation force from the stop spring mandrel 230 to the sleeve. The upper end and the lower end of the example releasable coupling assembly 300 are defined by two cylindrical coupler adjustment nuts 332 (upper) and 334 (lower). In between the two coupler adjustment nuts 332 and 334 are a shifting collet 310 and a cylindrical lug 315. The nut 332 is coupled to the shifting collet 310 (threadingly and/or otherwise), and the nut 334 is coupled to the lug 315 (threadingly and/or otherwise). The shifting collet 310 is ring that internally receives the actuator sleeve 210 and has axial cuts that define a plurality of axially extending springing collet fingers. Each of the fingers of the shifting collet 310 have a dog portion defined by an inwardly protruding shoulder 311 on the lower edge of the collet 310. The shoulders 311 mate with a groove 313 on the exterior of the lug 315, coupling the collet 310 to move with the lug 315. The actuator sleeve 210 has an exterior profile 314 that mates with and grippingly engages a corresponding inner profile 316 of the lug 315, coupling the actuator sleeve 210 to move with the lug 315. In certain instances, the profiles 314, 316 are a male and female thread. The outer surface of the shifting collet 310 abuts and is held radially inward, i.e. supported, with shoulders 311 engaged in groove 313 by a first portion 320 of the internal bore of the housing 202. The first portion 320 of the internal bore of the housing 202 has an inner diameter that is smaller than that of a second portion 322 of the internal bore. In this coupling state, the shifting collet 310 is locked into coupling engagement with the lug 315, thus coupling the actuator sleeve 210 with the stop spring mandrel 230. Actuation loads from the actuator are transferred from the stop spring mandrel 230, which pushes against the upper coupler adjustment nut 332, to the shifting collet 310. The shifting collet 310 transfers the loads down to the lug 315 and into the actuator sleeve 210. The loads shift the actuator sleeve 210 axially, and shift the valve fork 212 to operate the ball-type valve closure 204 as shown in FIGS. 2A and 2B.

The collet 310 is unsupported and released to uncouple from the lug 315 when the coupling assembly 300 translates downhole from the first portion 320 of the internal bore to the second portion 322 of the internal bore. As noted above, the second portion 322 has a larger diameter than the first portion 320. Thus, as the collet 310 moves into the second portion 322, the outer surface of the collet 310 loses contact with the wall of the housing 202. When out of contact, the collet 310 is unsupported and no longer radially constrained. Each cantilever beam of the collet 310 is allowed to radially expand, for example, when axial force over a specified force is applied through the shoulder 311/groove 313 interface, to allow the shoulder 311 to uncouple from the groove 313 and disengage the collet 310 from the lug 315 (FIG. 3C). Finally, when the collet 310 is uncoupled from the groove 313, the actuation sleeve 210 can move axially relatively freely in relation to the coupling assembly 300.

The locations of the first portion 320 and second portion 322 of the internal bore of the housing 202 are selected so that, prior to remote operation of the actuator, the coupling assembly 300 is in the first portion 320 and the collet 310 is held to lock the actuator sleeve 210 to the stop spring mandrel 230 of the actuator (at least in one direction). After remote operation of the actuator, the coupling assembly is in the second portion 322 and the collet 310 is released to uncouple the actuator sleeve 210 from the stop spring mandrel 230 of the actuator. The second portion 322 can be further positioned such that the valve closure is fully operated prior to the coupling assembly 300 moving into the second portion 322 to ensure its full operation before possible decoupling.

Notably, prior to operation of the actuator and while the shifting collet 310 is coupled to the lug 315, the actuator sleeve 210 can be engaged and manipulated downhole, for example using a shifting tool in the central bore 216, without disengaging the coupling assembly 300. The actuator sleeve 210 can be shifted downhole, because the stop spring mandrel 230 of the actuator merely abuts the nut 332 and is not coupled to retain the nut 332 (and the remainder of the coupling assembly 300) uphole. Such a configuration allows a valve employing the coupling assembly 300 to be mechanically operated with a shifting tool an unlimited number of times prior to being remotely operated with the actuator assembly. The specified force at which the collet 310 uncouples from the lug 315 (and thus actuator sleeve 210) when the collet 310 is unsupported can be selected so that the collet 310 maintains engagement to the lug 315 (and actuator sleeve 210) when the actuator sleeve is shifted prior to remotely operating the actuator. The specified force can be substantially less than the force applied through the stop spring mandrel 230 by the actuator. In certain instances, the depth and or shape of engagement between the shoulder 311 and groove 313 can be configured so that the specified force necessary to uncouple the released collet 310 is 6500 lbs (~3,000 kgs).

Figure 4A:
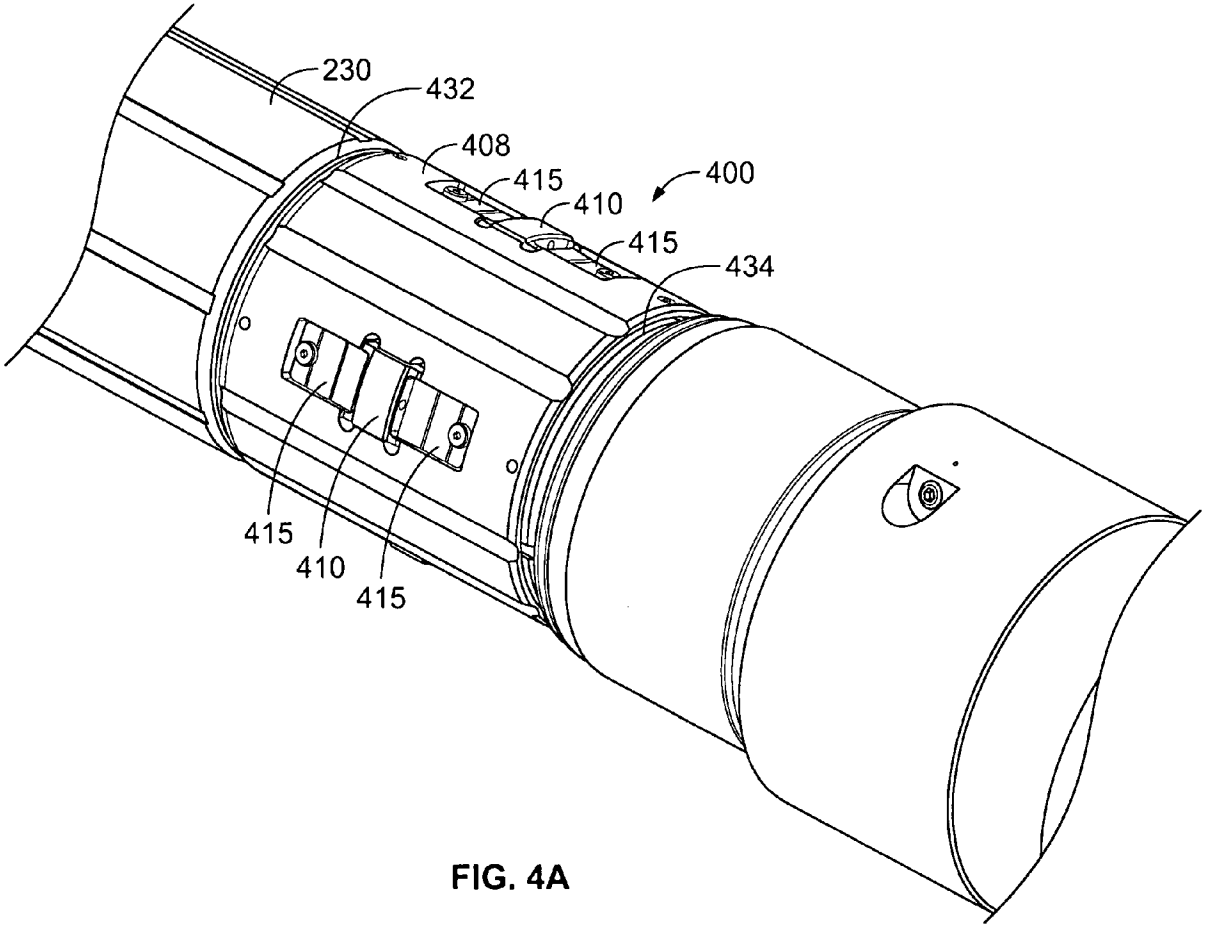
FIGS. 4A, 4B and 4C are detailed views of a second example releasable coupling assembly.
Figure 4B:
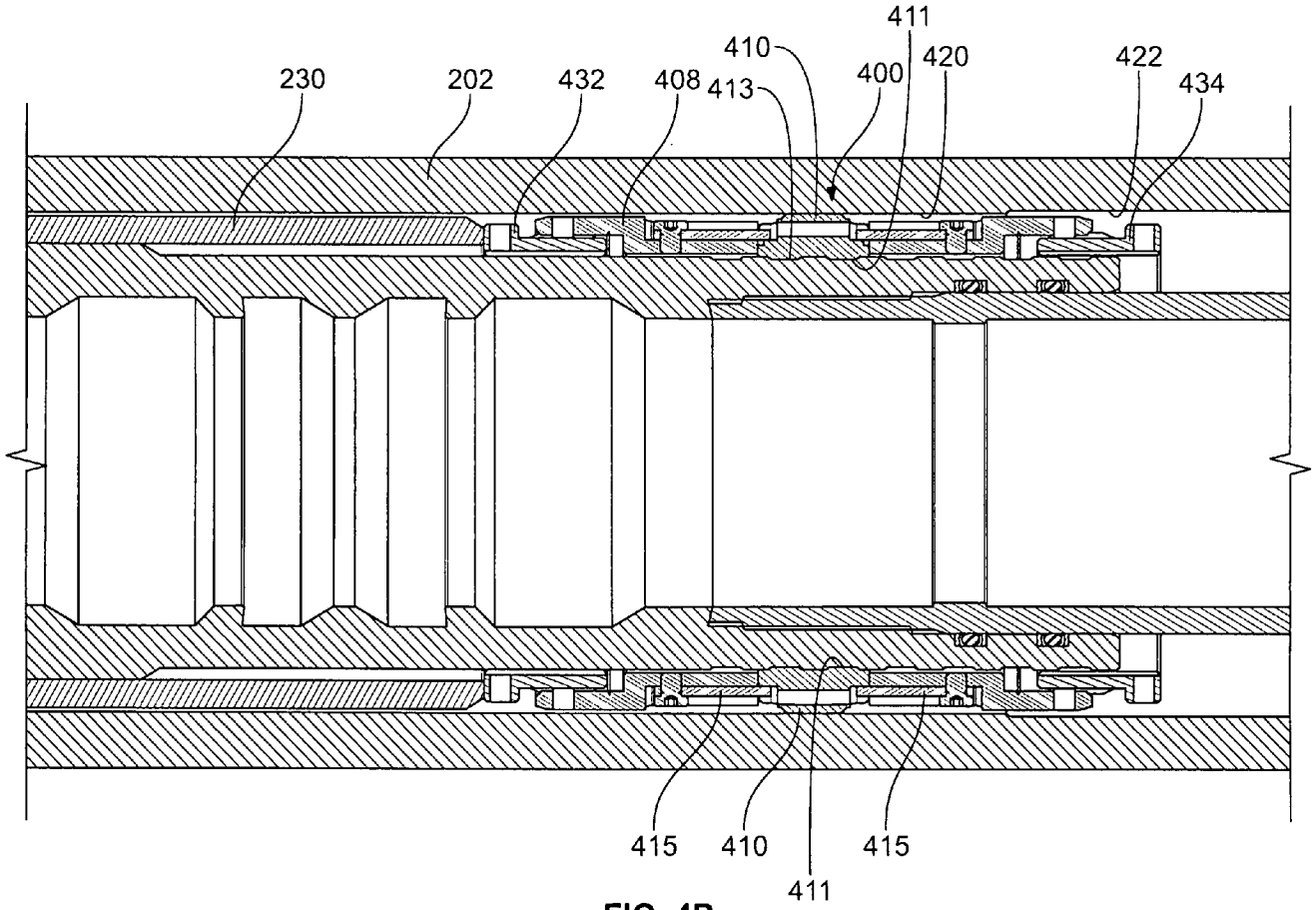
Figure 4C:
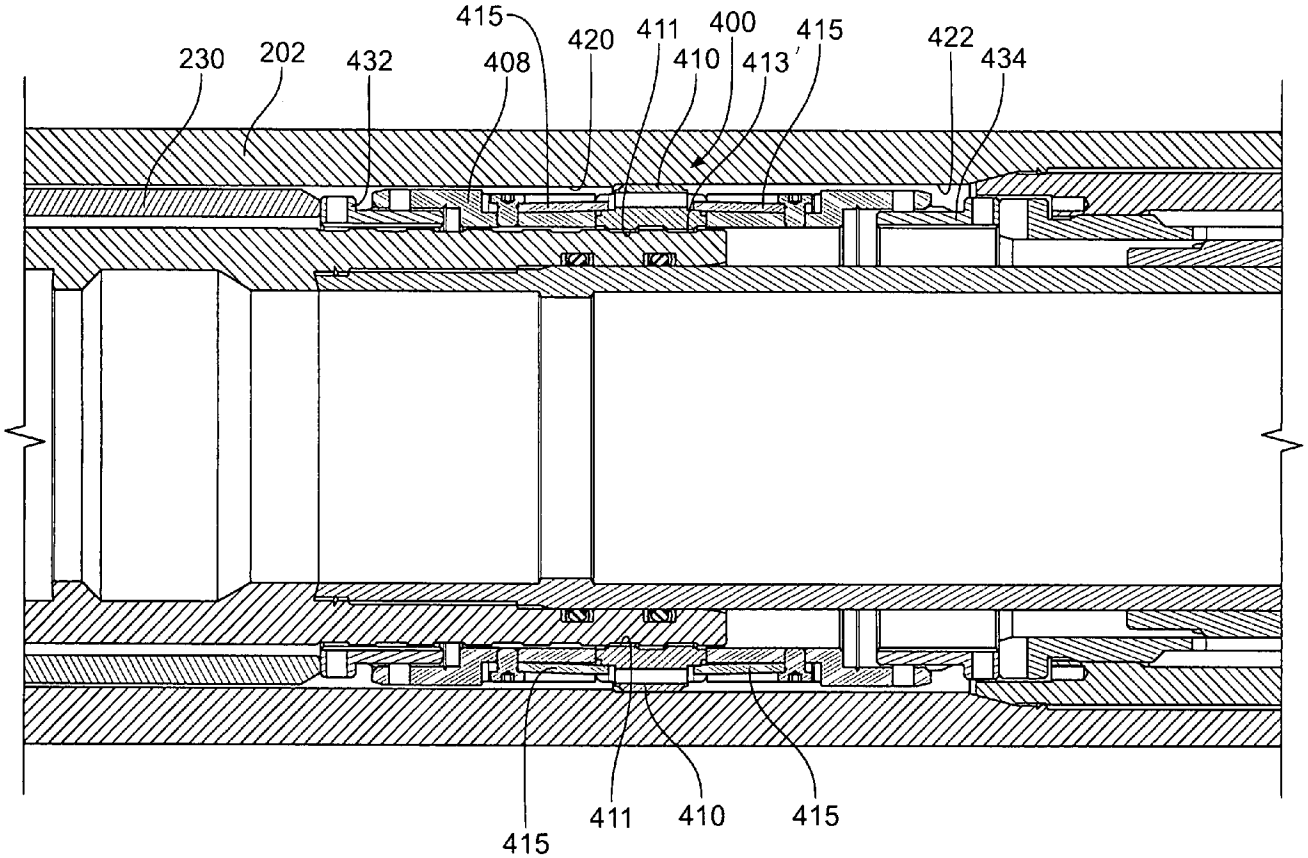

Referring now to FIGS. 4A, 4B, and 4C, another example releasable coupling assembly 400 is shown. The example releasable coupling assembly 400 can be used as releasable coupling assembly 224. FIGS. 4A and 4B show the coupling assembly coupling the remote actuator assembly to the actuator sleeve in a perspective view (with the housing 202 omitted) and in a side cross sectional view, respectively. FIG. 4C shows, in a side cross-sectional view, the coupling assembly uncoupled so that the actuator sleeve moves freely with respect to the remote actuator assembly.

As with the embodiment above, example releasable coupling assembly 400 transmits force from the stop spring mandrel 230 to the actuator sleeve 210. The upper end and the lower end of the example releasable coupling assembly 400 are defined by two cylindrical coupler adjustment nuts 432 (upper) and 434 (lower). In between the two coupler adjustment nuts 432, 434 is a cylindrical dog carrier 408 carrying a plurality of azimuthally spaced dogs 410 in openings of the dog carrier 408. The dogs 410 are supported in the dog carrier 408 by leaf springs 415 coupled to both the dog and the carrier. The nuts 432, 434 are coupled to the dog carrier 408 (threadingly and/or otherwise). Each of the dogs 410 have an internal profile 411 that mates with and grippingly engages a corresponding profile 413 on the exterior actuator sleeve 210. When engaged, the profiles 411, 413 couple the dogs 410 (and coupling assembly 400) to move with the actuator sleeve 210. The outer surface of the dog 410 abuts and is held radially inward, i.e. supported, with profile 411 engaged in profile 413 by a first portion 420 of the internal bore of the housing 202. The first portion 420 of the internal bore of the housing 202 has an inner diameter that is smaller than that of a second portion 422 of the internal bore. In this coupling state, the dog 410 is locked into coupling engagement with the lug 415, thus coupling the actuator sleeve 210 with the stop spring mandrel 230. Actuation loads from the actuator are transferred from the stop spring mandrel 230, which pushes against the upper coupler adjustment nut 432, to the dog 410. The dog 410 transfers the loads down into the actuator sleeve 210. The loads shift the actuator sleeve 210 axially, and shift the valve fork 212 to operate the ball-type valve closure 204 as shown in FIGS. 2A and 2B.

The dog 410 is unsupported and released to uncouple from the lug 415 when the coupling assembly 400 translates downhole from the first portion 420 of the internal bore to the second portion 422 of the internal bore (FIG. 4C). As noted above, the second portion 422 has a larger diameter than the first portion 420. Thus, as the dog 410 moves into the second portion 422, the outer surface of the dog 410 loses contact with the wall of the housing 202. When out of contact, the dog 410 is unsupported and no longer radially constrained. The dogs 410 are allowed to move radially outward, for example, when axial force over a specified force is applied through the profile 411/profile 413 interface, to allow the profile 411 to ratchet over the profile 413 and the dogs 410 to momentarily uncouple from the actuator sleeve 210. In this configuration, the actuator sleeve 210, when subjected to a force over the specified force, can move axially relative to the stop spring mandrel 230 of the actuator.

The locations of the first portion 420 and second portion 422 of the internal bore of the housing 202 are selected so that, prior to remote operation of the actuator, the coupling assembly 400 is in the first portion 420 and the dog 410 is held to lock the actuator sleeve 210 to the stop spring mandrel 230 of the actuator (at least in one direction). After remote operation of the actuator, the coupling assembly is in the second portion 422 and the dog 410 is unsupported. The second portion 422 can be further positioned such that the valve closure is fully operated prior to the coupling assembly 400 moving into the second portion 422 to ensure its full operation before possible decoupling.

As above, prior to operation of the actuator and while the dog 410 is coupled to the actuator sleeve 210, the actuator sleeve 210 can be engaged and manipulated, for example using a shifting tool in the central bore 216, without disengaging the coupling assembly 400. The actuator sleeve 210 can be shifted downhole, because the stop spring mandrel 230 of the actuator merely abuts the nut 432 and is not coupled to retain the nut 432 (and the remainder of the coupling assembly 400) uphole. Such a configuration allows a valve employing the coupling assembly 400 to be mechanically operated with a shifting tool as many times as is desired prior to being remotely operated with the actuator assembly. The specified force at which the dog 410 uncouples from the lug 415 (and thus actuator sleeve 210) when the dog 410 is unsupported can be selected so that the dog 410 maintains engagement to the lug 415 (and actuator sleeve 210) when the actuator sleeve is shifted prior to remotely operating the actuator. In certain instances, the depth and or shape of engagement between the profile 411 and profile 413 and/or the rate of leaf springs 415 can be configured so that the specified force necessary to uncouple the released dog 410 is 6500 lbs (~3,000 kgs).

Figure 5A:
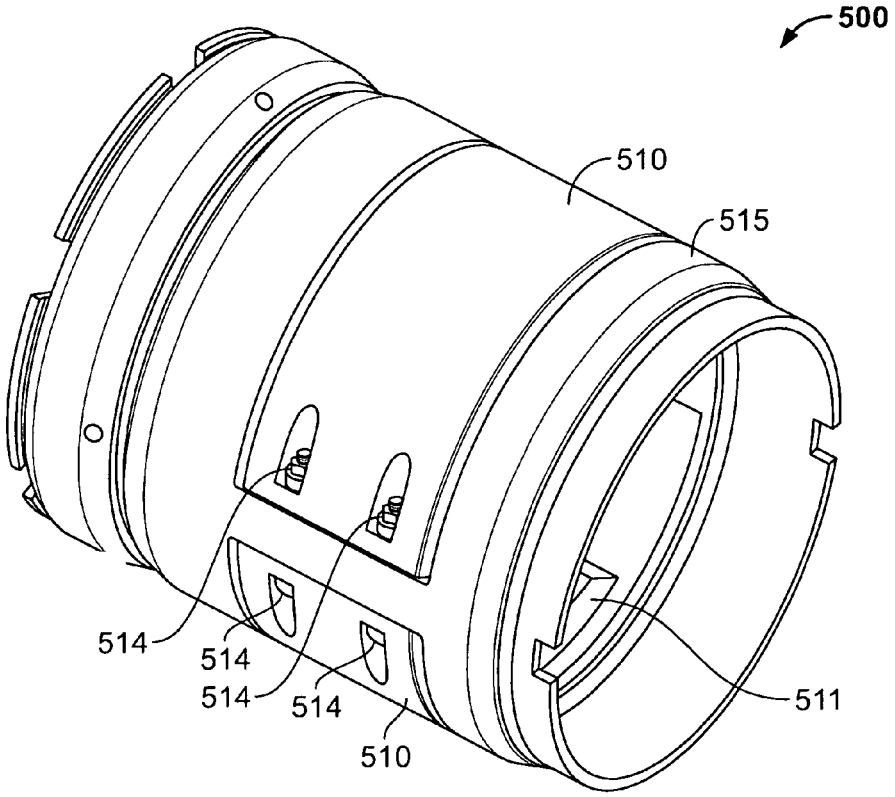
FIGS. 5A, 5B and 5C are detailed views of an example releasable coupling assembly.
Figure 5B:
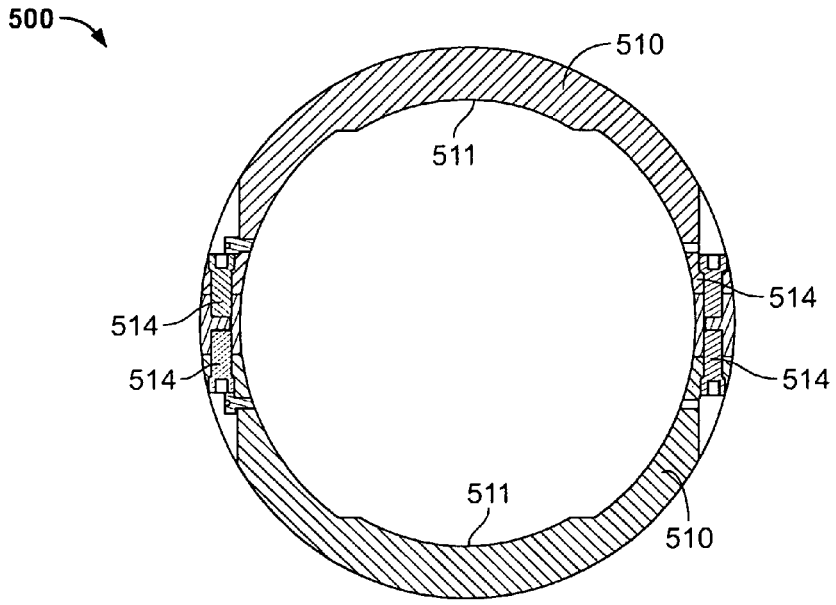
Figure 5C:
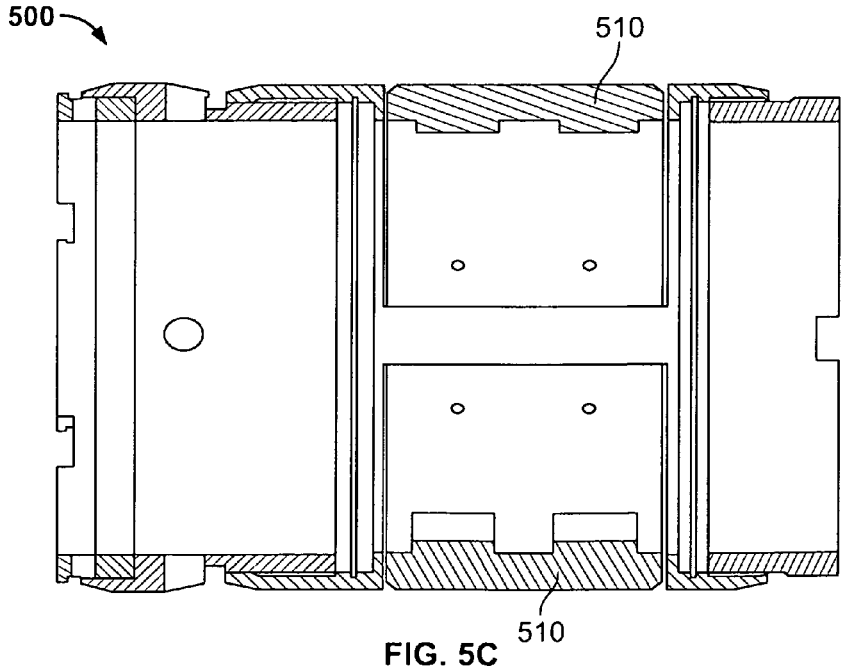

FIGS. 5A, 5B and 5C depict an alternative coupling assembly 500 that can be used in place of the coupling assembly 400 of FIGS. 4A-C. The coupling assembly 500 includes a cylindrical carrier 515 with openings for two semi-cylindrical shells 510. The shells 510 are a form of dogs, and operate like the dogs 410 described above. The two semi-cylindrical shells 510 are held to the carrier 515 by a plurality of tensile pins 514. In the embodiment shown, each shell 510 has four tensile pins 514, with two at each end. When held to the carrier 515 as shown in FIG. 4A, an internal profile 511 on the interior surface of the shells 510 mates with and grippingly engages a mating profile (like profile 413) on the exterior of the actuator sleeve 210. When engaged, the profiles couple the shells 510 (and coupling assembly 500) to the actuator sleeve 210.

When the coupling assembly 500 is in the first portion of the inner bore of the housing, the outer surface of the shells 510 is held radially inward, i.e., supported, by the housing with the profiles 511 of the shells engaged in profile of the actuator sleeve. When the coupling assembly 500 is shifted to the second portion of the inner bore, the shells 510 are unsupported, but the tensile pins 514 retain the shells 510 radially inward, engaged with the actuator sleeve 210. The shell profiles 511 and actuator sleeve profile are ramped to generate a radial force when an axial force is applied through the profile interface. Thus, an axial force above a specified force is applied to through the profile generates a radial component tending to push the shells 510 apart, and causes the tensile pins 514 break. The specified axial force at which the shells 510 break the tensile pins 514 (and thus uncouple from the actuator sleeve 210) can be selected so that the shells 510 maintain engagement to the actuator sleeve 210 when the actuator sleeve is shifted prior to remotely operating the actuator. Such a configuration allows a valve employing the coupling assembly 500 to be mechanically operated with a shifting tool an unlimited number of times prior to being remotely operated with the actuator assembly. The shells 510 can expand radially to an open position releasing the actuator sleeve 210 to uncouple from the actuator when the tensile pins 514 are broken. The coupling assembly 500 further includes a number of springs 420 between the carrier 515 and the shells 510, for example received over the tensile pins 514, to help bias the shells 510 apart once the tensile pins 514 are broken.

The coupling assemblies above operate to couple the remote actuator to the actuator sleeve in a manner that can transmit a high amount of force from the actuator. In certain instances, this allows using a remote actuator with a high firing force in the well tool, and prevents inadvertent uncoupling the actuator from the actuator sleeve before and during actuation of the remote actuator. After actuation, the coupling assemblies are unsupported to allow the actuator sleeve to uncouple from the remote actuator with a low, specified force. In certain instances, specified force can be much less than the firing force of the remote actuator, so that the requisite force can be generated with a shifting tool manipulated from the surface.

A number of examples have been described. Nevertheless, it will be understood that various modifications may be made. Accordingly, other examples are within the scope of the following claims.

What is claimed is:

1. A well tool, comprising:

a housing;

an actuator sleeve in the housing, the actuator sleeve having an internal shifting tool engaging profile;

an actuator in the housing, the actuator responsive to a remote signal to move the actuator sleeve from a first position to a second position; and a dog in the housing supported to couple the actuator sleeve to the actuator when the actuator sleeve is in the first position and unsupported to allow the actuator sleeve to uncouple from the actuator when the actuator sleeve is in the second position, where the housing comprises a first internal diameter and a second, larger internal diameter, and the first internal diameter retains the dog inward in engagement with the actuator sleeve and coupling the actuator sleeve to the actuator when the dog is beneath the first internal diameter, and the dog is allowed to move outward, releasing the actuator sleeve to uncouple from the actuator when the dog is beneath the second internal diameter.

2. The well tool of claim 1, where the dog is beneath the first internal diameter when the actuator sleeve is in the first position and the dog is beneath the second internal diameter when the actuator sleeve is in the second position.

3. The well tool of claim 1, where the dog grippingly engages a profile on an exterior of the actuator sleeve when the dog couples the actuator sleeve to the actuator.

4. The well tool of claim 3, where the profile comprises a thread.

5. The well tool of claim 3, where the profile is ramped to drive the dog out of gripping when an axial load is applied to the actuator sleeve.

6. The well tool of claim 1, where the actuator sleeve is coupled to a ball valve and operates the ball valve between an open and closed state when the actuator sleeve is moved between the first position and the second position.

7. The well tool of claim 1, where the internal shifting tool engaging profile allows the actuator sleeve to be moved by a shifting tool.

8. The well tool of claim 1, further comprising a dog carrier around the actuator sleeve, and where the dog is coupled to the dog carrier by a spring.

9. The well tool of claim 1, where the dog comprises a first semi-cylindrical shell member and a second semi-cylindrical shell member both positioned around the actuator sleeve and retained together by a tensile pin.

10. The well tool of claim 9, where the shells are radially displaceable to an open position releasing the actuator sleeve to uncouple from the actuator, and the tensile pin is broken when the shells are radially displaced to the open position.

11. The well tool of claim 10, further comprising a spring between the shells biasing the shells to an open position.

12. The well tool of claim 1, further comprising a lug on the actuator sleeve, and the dog engages the lug when supported to couple the actuator sleeve to the actuator.

13. The well tool of claim 12, where the housing has a first internal diameter and a second, larger internal diameter, and the first internal diameter supports and retains the dog inward in engagement with the lug and coupling the actuator sleeve to the actuator when the dog is beneath the first internal diameter, and the dog is unsupported and allowed to move outward, releasing the actuator sleeve to uncouple from the actuator when the dog is beneath the second internal diameter.

14. A method of actuating a well tool, comprising:

supporting a dog to couple a portion of an actuator to an actuator sleeve by inwardly supporting the dog with an inner diameter of a housing of the well tool, where the dog is inwardly supported in gripping engagement with a lug threaded to an exterior of the actuator sleeve;

operating the actuator to axially shift the portion and the actuator sleeve while the dog is coupling the portion to the actuator sleeve; and then, unsupporting the dog to allow the actuator sleeve to uncouple from the actuator.

15. The method of claim 14, where unsupporting the dog comprises shifting the dog radially beneath a second inner diameter of the housing that is larger than the first mentioned inner diameter of the housing.

16. The method of claim 14, where shifting the actuator sleeve moves a valve closure of the tool between an open and closed state.

17. A device for use in a subterranean well, the device comprising:

an actuator responsive to actuate in response to a signal generated remote from the device;

an actuator sleeve coupled to an actuated element of the device to operate the actuated element when the actuator shifts axially in the device; and a dog that couples the actuator to the actuator sleeve and allows the actuator to uncouple from the actuator sleeve when the actuator has been remotely actuated, where the dog grippingly engages a profile on an exterior of the actuator sleeve when the dog couples the actuator sleeve to the actuator.

18. The device of claim 17, where the actuator sleeve can be shifted axially without axially shifting a portion of the actuator.

19. A well tool, comprising:

a housing;

an actuator sleeve in the housing, the actuator sleeve having an internal shifting tool engaging profile;

an actuator in the housing, the actuator responsive to a remote signal to move the actuator sleeve from a first position to a second position; and a dog in the housing supported to couple the actuator sleeve to the actuator when the actuator sleeve is in the first position and unsupported to allow the actuator sleeve to uncouple from the actuator when the actuator sleeve is in the second position, where the dog grippingly engages a profile on an exterior of the actuator sleeve when the dog couples the actuator sleeve to the actuator.

20. A well tool, comprising:

a housing;

an actuator sleeve in the housing, the actuator sleeve having an internal shifting tool engaging profile;

an actuator in the housing, the actuator responsive to a remote signal to move the actuator sleeve from a first position to a second position;

a dog in the housing supported to couple the actuator sleeve to the actuator when the actuator sleeve is in the first position and unsupported to allow the actuator sleeve to uncouple from the actuator when the actuator sleeve is in the second position; and a dog carrier around the actuator sleeve, the dog coupled to the dog carrier by a spring.

21. A well tool, comprising:

a housing;

an actuator sleeve in the housing, the actuator sleeve having an internal shifting tool engaging profile;

an actuator in the housing, the actuator responsive to a remote signal to move the actuator sleeve from a first position to a second position; and a dog in the housing supported to couple the actuator sleeve to the actuator when the actuator sleeve is in the first position and unsupported to allow the actuator sleeve to uncouple from the actuator when the actuator sleeve is in the second position, where the dog comprises a first semi-cylindrical shell member and a second semi-cylindrical shell member both positioned around the actuator sleeve and retained together by a tensile pin.

22. A well tool, comprising:

a housing;

an actuator sleeve in the housing, the actuator sleeve having an internal shifting tool engaging profile;

an actuator in the housing, the actuator responsive to a remote signal to move the actuator sleeve from a first position to a second position;

a dog in the housing supported to couple the actuator sleeve to the actuator when the actuator sleeve is in the first position and unsupported to allow the actuator sleeve to uncouple from the actuator when the actuator sleeve is in the second position; and a lug on the actuator sleeve, where the dog engages the lug when supported to couple the actuator sleeve to the actuator.

* * * * *